United States Patent [19]

Pronin

[11] 4,023,798

[45] May 17, 1977

[54] TENNIS SERVE TRAINING DEVICE

[76] Inventor: Alexander Pronin, 1110 W. San Jose, Fresno, Calif. 93704

[22] Filed: May 10, 1976

[21] Appl. No.: 684,876

[52] U.S. Cl. ..... 273/29 A; 35/29 R
[51] Int. Cl.[2] ..... A63B 61/00
[58] Field of Search ..... 273/29 A, 29 R, 1 R; 35/29 R

[56] References Cited

UNITED STATES PATENTS

| | | | |
|---|---|---|---|
| 2,305,187 | 12/1942 | Neiden | 273/29 A |
| 3,893,669 | 8/1975 | Myers | 273/29 A |
| 3,948,517 | 4/1976 | Feiler | 273/29 A |

FOREIGN PATENTS OR APPLICATIONS

| | | | |
|---|---|---|---|
| 117,888 | 12/1943 | Australia | 273/29 A |
| 1,506,470 | 11/1967 | France | 273/29 R |
| 425,851 | 10/1947 | Italy | 273/29 A |
| 426,584 | 6/1967 | Switzerland | 273/29 R |
| 240,552 | 6/1925 | United Kingdom | 273/29 A |
| 489,842 | 8/1938 | United Kingdom | 273/29 A |

*Primary Examiner*—Richard C. Pinkham
*Assistant Examiner*—T. Brown
*Attorney, Agent, or Firm*—Vergil L. Gerard

[57] ABSTRACT

Disclosed is a device for aiding a student of tennis in perfecting his serve. The device consists of a frame which supports an overhead target, and a cooperating ground surface target. The overhead target is movably mounted and adjustable in height so that its lowermost surface can be readily placed at the optimum toss height for the user's serve and it will move when struck to indicate an overtoss. It has a visible target pattern thereon related to a pattern on the ground target, which is positioned directly under the overhead target so that a straight dropping tossed ball will strike a like position on both targets. The overhead target also has depending strike height markers to indicate the desired height at which a toss serve ball should be struck with the racquet.

10 Claims, 6 Drawing Figures

Fig. 5
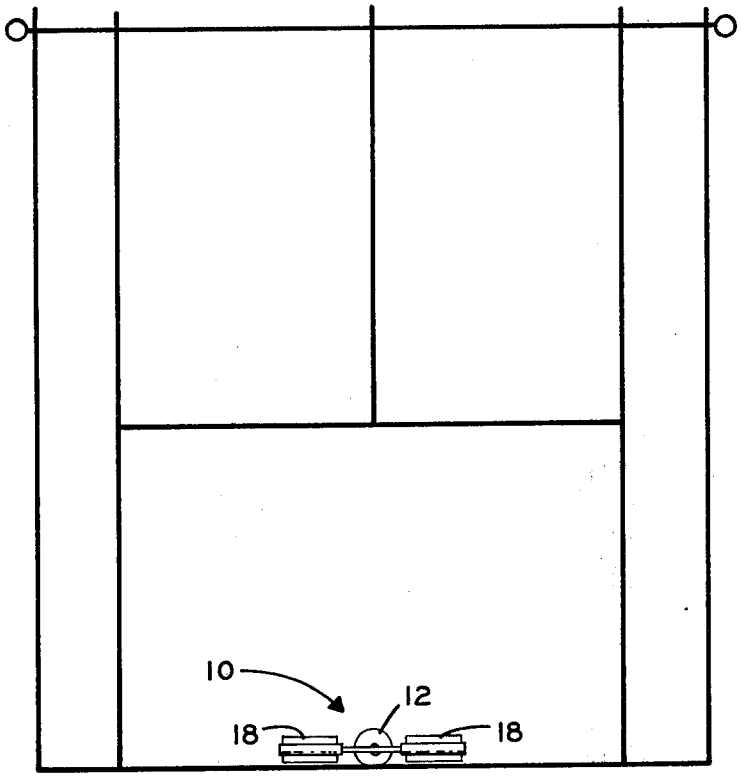
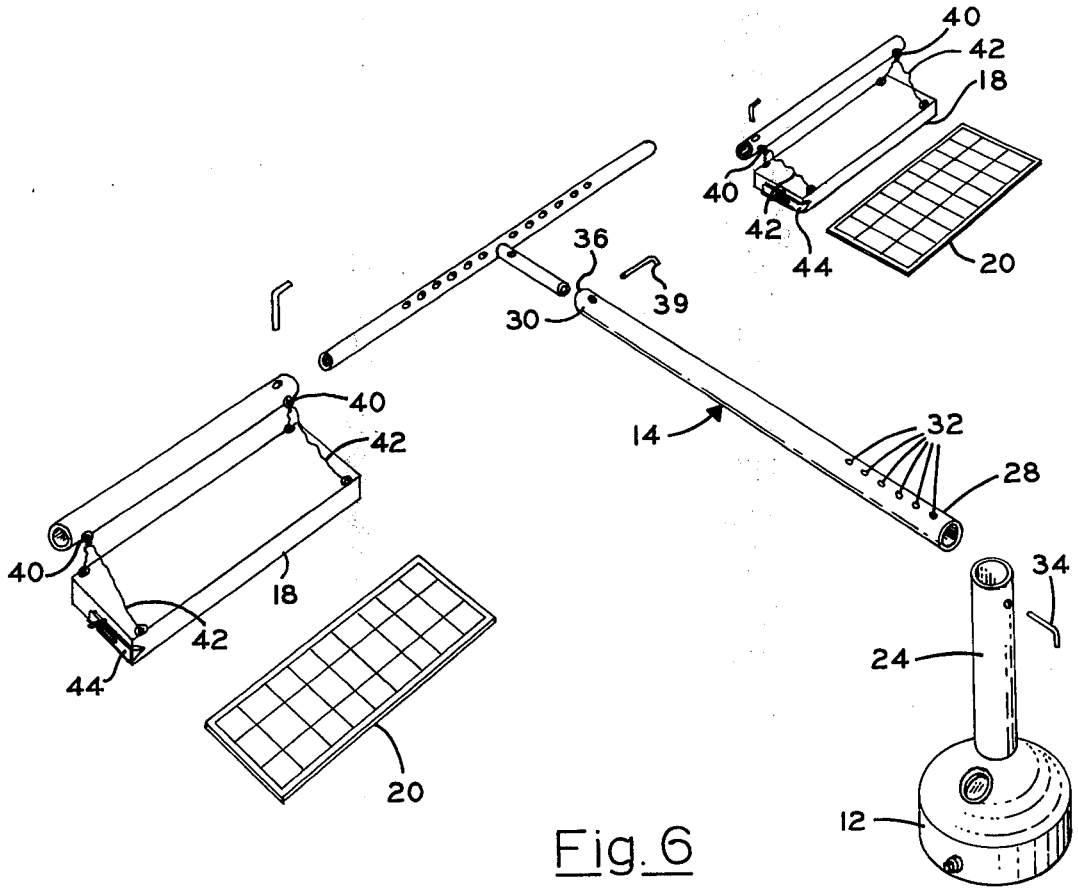
Fig. 6

TENNIS SERVE TRAINING DEVICE

BACKGROUND OF INVENTION

This invention relates generally to tennis training aids and more particularly to devices for aiding a player in improving his serve. In recent years the sport of tennis has become increasingly popular with the result that many new people desire to learn the sport and improve their skills. With the aid of backboards, cushioned backboards, automatic ball machines and similar training aids, it is now possible to learn many of the necessary skills more rapidly. The serving skill is not significantly assisted by these devices, however, and there are few, if any, other aids which significantly help the student to learn this skill.

A good tennis serve requires proper body position with respect to the court, proper grip, proper swing, and most important, the proper toss of the ball. To make a serve effective, the player must consistently toss the ball to a proper height and in a manner which places it a proper distance from the body and causes it to fall in a relatively straight vertical line toward the court, and must time his swing to strike the ball at the proper position in the fall. The player's proper position with respect to the court and his grip and swing can be relatively quickly learned with good instruction. A proper toss and proper timing of the strike are much more difficult to learn, however, and require a great deal of practice.

The greatest difficulty experienced by tennis students in achieving a proper toss is the lack of reference points to guide the direction, height and line of fall of a tossed ball. Some tennis coaches instruct students to make their toss by raising the arm in an extended position from their side up to about head height and then release the ball in order to guage proper spacing from the body. They direct students to determine proper toss height by holding their racquet in an extended position above their head, and to make their toss 8 to 12 inches above that position. They also instruct the player to attempt to make his toss in such a way that the fall of the ball will be substantially vertical, and often designate a point on the ground a certain distance forward of the student's toe where a well tossed ball, if not struck with the racquet, will hit. A generally suggested striking height is in the top third of the racquet, which students can measure by holding the extended racquet above their head and estimating. Trying to achieve all these criteria without reference points, however, is a frustrating activity for the tennis student, which requires long hours of practice and generally results in the beginner's serve being the weakest aspect of his game.

A need, therefore, exists for a tennis training aid which will assist the tennis student in more readily achieving a proper serve toss, and properly coupling this toss with his serve swing.

It is, therefore, a major object of this invention to provide a tennis training aid which orients for the student proper toss height, distance from the body, and ball fall, and proper strike height.

It is also an important object of this invention to provide a tennis training aid of the type described which is not only useful for practicing the serve toss but permits an actual serve to be carried out without interference.

It is another object of my invention to provide a tennis training aid of the type described which provides correlated overhead and ground targets which both direct the tennis player's toss and indicate when he has achieved the proper direction and fall.

It is a further object of my invention to provide a tennis training aid of the type described which provides the tennis student with a reference for proper toss height and indicates when his toss is over or under desired height.

It is still another object of my invention to provide a tennis training aid of the type described which provides an easy strike height reference for the tennis player.

It is still a further object of my invention to provide a tennis training aid of the type described which is easy to use, readily portable, relatively inexpensive and sufficiently durable to withstand the rigors of training use.

These and other objects and advantages of my invention will become more readily apparent from the following detailed description of a preferred embodiment and the accompanying drawings in which:

FIG. 5 is a plan view of the preferred embodiment of my invention shown in relationship to a tennis court; and FIG. 6 is a perspective view showing the preferred embodiment of my invention in its disassembled condition for portability.

DETAILED DESCRIPTION OF PARTS

Figure 1:
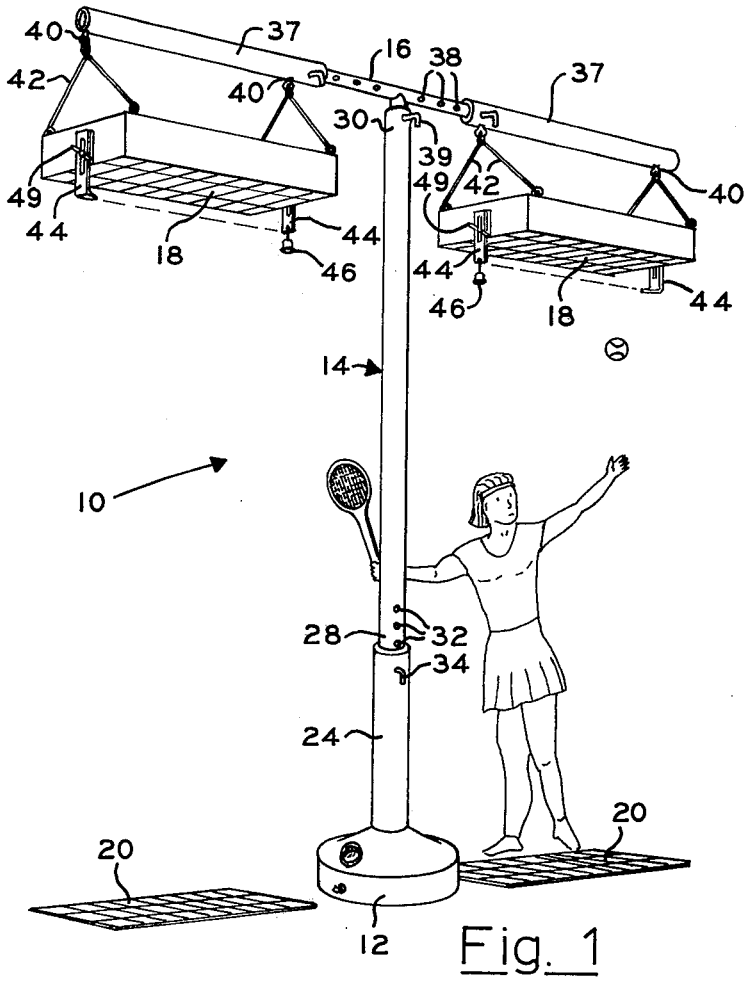
FIG. 1 is a perspective view of the preferred embodiment shown in use relationship with a tennis player.

Referring now to the drawings, and particularly FIG. 1 thereof, the numeral 10 designates generally a preferred embodiment of my tennis training aid.

The tennis training aid 10 has a base 12, upright stanchion 14, a lateral support arm 16, overhead targets 18, and a ground target 20.

The base 12 is formed of concrete of sufficient weight to provide a satisfactory anchor for the other members of the device, or, for greater portability, it can be a metal or plastic shell which is filled with water when in use. The base 12 has a receptacle 24 which extends upward from its top surface to telescopically receive and mount the bottom of the stanchion 14.

The stanchion 14 has a bottom 28 and a top 30. Telescopic assembly between the bottom 28 of the stanchion 14 and the receptacle 24 is accomplished by providing a plurality of aligned pairs of holes 32 in the adjacent ends of each of the members and a lock pin 34 which passes through aligned pairs of the holes to lock the members together at the desired elevational position. By means of the pairs of holes 32 and the lock pin 34, the stanchion is adjusted in height to accommodate the user.

At the upper end 30 of the stanchion 14, a socket 36 is provided which slidably contains a T-leg on the support arm 16 with the opposite ends of the support arm extending from each side of the socket. A pair of sleeves 37 are provided, one on each end of the support arm 16 to extend the ends of the arm. Aligned pairs of parallel holes 38 are provided in the midsection of the support arm 16 and in the sleeves 37 so the arm can be laterally adjusted, and an arm set pin is passed through the holes to hold the sleeves when properly adjusted. A lock hold and pin 39 hold the T-leg of the support arm 16 in the top 30 of the stanchion 14. At each of the extended opposite ends of the support arm 16 a pair of spaced attachment eyes 40 are provided. An overhead target 18 is suspended from each end of the support arm 16 by flexible suspension cords 42 of rope or chain which pass through the eyes 40 and connect to the corners of the target.

At each end of each of the overhead targets 18 is mounted a strike height indicator 44. The strike height indicator 44 is a plastic member pivotally connected at its upper end to an end of one of the overhead targets and having a bell 46 at its lower end. The rods are pinned to the ends of the overhead targets by mounting screws 48 for pivotal suspension so that if struck they swing about the screws. The strike height indicators 44 have slots 48 in their upper ends that receive the screws 47 and the indicators are adjustable on the screws by means of wing nuts 49.

The ground target 20 is substantially the same size and shape as one of the overhead targets except that it is made of a thinner, heavier material, sufficiently flexible to lie flat along the ground and sufficiently rigid to be easily picked up and turned over. The ground target 20 is used on both sides, one side having a pattern matching the right hand overhead target and the other side having a pattern that matches the left hand overhead target.

Figure 2:
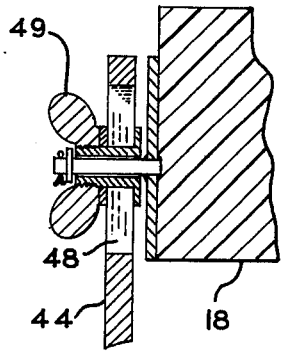
FIG. 2 is a partial sectional view of a strike heighth idicator.

In FIG. 2 I show in the upper portion the lefthand and righthand target patterns for the overhead targets 18, and in the lower portion the lefthand and the righthand target patterns for the ground target 20. Although the patterns shown, which utilize ball size squares with numbers and colors, have been found to be very satisfactory, it should be understood that any pattern which provides an appropriate point of reference to guide the user's ball toss and can be readily related between targets to indicate the ball fall direction, will perform satisfactorily.

OPERATION

Figure 4:
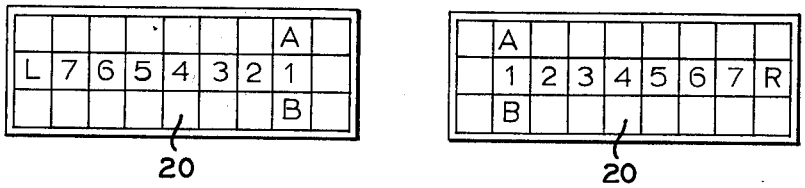

Now that I have described the parts and structure of my tennis training aid, I will now indicate its mode of operation. The training aid 10 is taken to the site of desired use in its portable condition as shown in FIG 4. As previously indicated, the base 12 may be made of concrete or of a plastic or metal shell and filled with water at the site to lend greater portability where desired.

Figure 3:
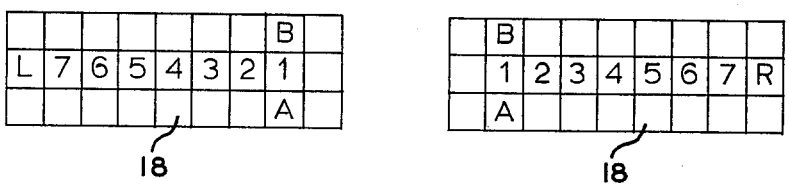
FIGS. 3 and 4 are plan views, respectively, targets utilized in my preferred embodiments.

The base 12 is placed on the tennis court at the junction of the back line and the center divider line of the court as best seen in FIG. 3. The receptacle 24 is disposed upwardly and receives the bottom 28 of the stanchion 14. The bottom 28 of the stanchion 14 is then telescopically assembled with the receptacle 24 by aligning pairs of aligned holes 32 and inserting the lock pin 34.

Before placing the stanchion 14 in the receptacle 24, the support arm 16 is inserted in the socket 36, and the lefthand and righthand overhead targets 18 are mounted on their respective ends of the support arm. Then when the stanchion 14 is placed in the receptacle 24, the overhead targets 18 are properly suspended over the head of the user and at the top of the stanchion 14.

The user then regulates the height of the overhead targets 18 by stretching his racquet over his head to determine how close the racquet comes to the target and by moving the top 30 of the stanchion 14 in the receptacle 24 until the lowermost surface of the overhead targets are about 8 to 12 inches above the top of his racquet. In other words, he locates the lower surface of the overhead targets at the desired toss height. Next the user determines the proper positioning of his feet with respect to the base line (see FIG. 3), and from this location, by proper instruction, he determines the desired location for a properly tossed serve to strike the ground. This determination of the proper ground position for his serve toss is made, in using my apparatus, by reference to the ground target which is set in the court before the user just forward of the base line, and, assuming he is serving to the left, just to the right of the centerline. If this position indicates the square 3, for example, the user then arranges the overhead target 18, on the lefthand side of the support arm, so that it is positioned directly above and in alignment with the ground target, and notes the square 3 on the overhead target as the aim point for his serve toss. The ground target 20 has marker opening (not shown) in each corner of the blocks on the target pattern so that once the user has located his proper ground hit position, he may mark with chalk or other appropriate marker through the openings onto the court surface, remove the ground target, and thereafter refer only to the marked square on the court. If he prefers, of course, he can leave the ground target in place and refers to the square 3 on the ground target.

Having thus established his proper stance and determined the aim point for his toss on the overhead target and the corresponding correct drop point for the ball using the ground target 20, the user next proceeds to check his strike height. This is checked by a reference to the strike height markers 44 on each end of the lefthand overhead target 18. These markers should be adjusted to a position below the overhead target where a ball will be struck by the top third of the racquet in a normal serve swing.

Having thus adjusted the apparatus the user then proceeds to practice his toss. He does this by tossing the ball upward, aiming toward the block 3 on the overhead target, and then letting the serve toss fall to see if it strikes the corresponding block on the ground target (or marked square on the court). If he achieves this, the alignment of his toss is perfect.

With respect to toss height, he also attempts with his toss to cause the ball to just touch the overhead target. If the ball fails to touch the overhead target, his toss is too short, and if it strikes the target with sufficient force to move it about, his toss is too high, and the bell 46 will give an audible alarm. After practicing for a time in this manner the user is ready to start noting the strike height and timing his serve swing to bring about racquet contact at that height. Finally the server practices his complete serve with the apparatus still in place, by using his perfected serve toss and by timing of his serve swing to strike the ball at the indicated strike height.

When the user desires to serve to the lefthand court that is to the receiving court to his left he moves himself to the opposite side of the stanchion from where the user is shown in FIG. 1, and positions himself properly at the baseline and below the overhead target 18 on the righthand side of the stanchion 14. To provide the proper ground positioning, the user turns the ground target 20 over and moves it to the left side of the centerline just forward of the baseline. Again, he develops proper relationship between his feet and the proper ball drop position for a correctly tossed serve ball and notes that position by reference to a particular square on the ground target. In this case, let us assume it is square 5. He then assures that the overhead target 18 is positioned correctly above his ground target 20 and uses square 5 on the overhead target as his aim point. Thereafter he proceeds in the same manner as he did when serving in the lefthand direction, first practicing his toss, then practicing his strike height, and finally practicing his complete serve.

When the user is sufficiently confident of his serve he will, of course, try it without the training apparatus to see if he can maintain the consistency and skills which he has practiced with the training aid.

From this description of the operation of my invention it should be understood that it is a very effective training device for improving a tennis serve. Not only does it provide reference points to guide the user in improving his serve toss and strike heights, but it permits him to practice his complete serve in orientation with the apparatus to benefit from these reference points. Additional advantages of my invention are apparent from recognition of the essential features of a good serve toss. These include proper height, proper distance from the body, constant eye to ball contact, and the ability to select a good toss and strike it at the proper height. My invention aids the learning of all these essentials.

Particularly, it should be understood that my invention provides the advantages and achieves the objects heretofore attributed to it.

I claim:

1. A tennis training aid comprising:

a frame disposable in orientation to a tennis player positioned to serve a tennis ball, said frame having base means for supporting it in said disposition and overhead support means disposable over the head of the tennis player above the reach of his racquet;

overhead target means having a flat horizontally disposed lower surface with a target pattern thereon;

flexible elongated strap means for supporting said overhead target from said frame overhead support means, said strap means being interconnected between said overhead support means and said overhead target means; and ground target means disposable below said overhead target means and having a target pattern thereon correlated with the target pattern on the overhead target.

2. A tennis training of the type described in claim 1, in which:

said frame includes an upright stanchion with height adjustment means and a cross support arm mounted in the upper end thereof, and said base means of said frame includes a weighted base member positionable upon a ground surface and having receiving means to receive and support the bottom end of said upright stanchion.

3. A tennis training aid of the type described in claim 1, in which:

said overhead target means includes a generally rectangular relatively rigid target member of sheet material which is both durable and light weight.

4. A tennis training aid of the type described in claim 1, in which:

said ground target means includes a sheet of durable and flexible material readily disposable upon a flat surface.

5. A tennis training aid of the type described in claim 1, in which:

said overhead support means includes a central support arm and a pair of laterally extendable extension arms telescopically mounted one on each end of said central support arm;

and said overhead target means includes a pair of generally rigid targets each suspended from a different one of said extension arms.

6. A tennis training aid of the type described in claim 1, which further includes:

strike height indicator means for indicating to a user the proper height at which to strike a serve toss, said strike height indicator means being interconnected with and dependent from said overhead support means.

7. A tennis training aid comprising:

a frame having ground support means and an overhead support arm disposable above the racquet reach of a tennis player;

height adjustment means interconnected with said frame for adjusting the height of said overhead support arm to correspond to the size of a user;

an overhead target having a planar lower surface with a target pattern thereon;

flexible cord means interconnected between said overhead support arm and said overhead target for suspending said overhead target from said overhead support arm; and ground target locator means for locating and designating on the ground beneath each of the overhead targets a desired contact point for the fall of a properly tossed serve ball, said ground target locator means being interelated with said overhead target.

8. A tennis training aid as described in claim 7, in which:

said ground target locator means includes a mat of flexible material having a target pattern thereof related to the target pattern on said overhead target and having marker openings therein for marking on the ground beneath said target the location of a particular position in said target pattern.

9. A tennis training aid as described in claim 7, in which:

said overhead target has strike height indicator means including a pair of depending straps oppositely disposed on edges of said target and vertically adjustable to position their lowermost portions at a variety of distances below said lower surface of said target.

10. A tennis training aid as described in claim 7, in which:

said ground support means of said base includes a liquid receptacle with means for filling and draining liquid to provide anchor weight therefor;

said overhead target is a generally rectangular, relatively rigid sheet of material sufficiently light weight to be readily moved by contact with a serve tossed tennis ball, and has audible alarm means to indicate such movement, and said overhead target further has a pair of elongated strike height indicator members disposed at opposite ends thereof, said strike height members having proximal ends pivotally attached to said overhead target and distal ends depending therefrom below the lower surface of said target, and means for adjusting the distance of dependency of said distal strike height indicator members below said overhead target lower surface;

said ground target locator means includes a mat of flexible material having a target pattern thereon related to the target pattern on said overhead target and having marker openings therein for marking on the ground beneath said target the location of a particular position in said target pattern;

and which further includes:

a second overhead target substantially identical to said first overhead target and suspended from said overhead support arm by flexible cord means substantially identical to said flexible cord means suspending said first overhead target and being disposed in longitudinal alignment with said first overhead target;

and a second target pattern on said mat of said ground target locator means on the opposite side from said first target pattern and related to said target pattern on said second overhead target, whereby said mat may be overturned and disposed beneath said second overhead target to present said related target patterns to a user.

* * * * *